US008893940B2

(12) United States Patent
Green et al.

(10) Patent No.: US 8,893,940 B2
(45) Date of Patent: Nov. 25, 2014

(54) BAG OR PACK, SUCH AS A BACKPACK

(75) Inventors: Daniel Allan Green, Okotoks (CA); Michael Douglas Blenkarn, North Vancouver (CA)

(73) Assignee: Arc'Teryx Equipment Inc., North Vancouver, B.C. (CA)

( * ) Notice: Subject to any disclaimer, the term of this patent is extended or adjusted under 35 U.S.C. 154(b) by 1071 days.

(21) Appl. No.: 11/205,076

(22) Filed: Aug. 17, 2005

(65) Prior Publication Data

US 2006/0283907 A1 Dec. 21, 2006

(30) Foreign Application Priority Data

Jun. 20, 2005 (EP) ..... 05013246

(51) Int. Cl.
*A45F 3/08* (2006.01)
*A45F 3/04* (2006.01)

(52) U.S. Cl.
CPC ..... *A45F 3/08* (2013.01); *A45F 2003/045* (2013.01); *A45F 3/047* (2013.01); *A45F 3/04* (2013.01)
USPC ..... 224/628; 224/604; 224/630; 224/637; 224/262

(58) Field of Classification Search
USPC ..... 224/637, 650, 628, 630, 633, 261, 262, 224/604, 651
See application file for complete search history.

(56) References Cited

U.S. PATENT DOCUMENTS 3,347,429 A * 10/1967 Ruth, Jr ..... 224/633
3,767,040 A * 10/1973 Tushaus ..... 428/352
3,957,184 A * 5/1976 Shurman ..... 224/630
4,074,839 A * 2/1978 Wood et al. ..... 224/635
4,080,677 A * 3/1978 Koehler ..... 441/80
4,088,252 A * 5/1978 Grunberger ..... 224/629
4,213,549 A * 7/1980 Hibbard ..... 224/601
4,489,770 A * 12/1984 Reich, II ..... 206/320
4,653,290 A * 3/1987 Byrne ..... 62/372
4,750,654 A 6/1988 Menetrier
4,790,463 A * 12/1988 Hansen ..... 224/680
4,809,893 A * 3/1989 Parsons ..... 224/630
4,830,245 A * 5/1989 Arakaki ..... 224/628
4,920,575 A * 5/1990 Bartasis et al. ..... 2/457
5,131,576 A * 7/1992 Turnipseed ..... 224/262
5,320,262 A 6/1994 Lewis
5,361,955 A * 11/1994 Gregory ..... 224/630

(Continued)

FOREIGN PATENT DOCUMENTS

DE 27 54 061 A1 6/1979
EP 0 260 800 A2 3/1988

(Continued)

OTHER PUBLICATIONS

U.S. Appl. No. 11/779,636 (Gordon Rose et al.), filed Jul. 18, 2007.

*Primary Examiner* — Adam Waggenspack
*Assistant Examiner* — John Cogill
(74) *Attorney, Agent, or Firm* — Greenblum & Bernstein, P.L.C.

(57) ABSTRACT

A bag or pack, such as a backpack, having a pack portion that includes a back side made of flexible material, a carrying system directly or indirectly connected to the pack portion and including at least one carrying element, a frame connected to the pack portion, the frame including at least a rigid or semi-rigid sheet frame which is affixed to the back side of the pack portion by adhesive bonding.

55 Claims, 9 Drawing Sheets

(56) References Cited

U.S. PATENT DOCUMENTS

| | | | | |
|---|---|---|---|---|
| 5,366,126 | A | 11/1994 | Dausien | |
| 5,427,290 | A * | 6/1995 | Thatcher | 224/148.2 |
| 5,641,325 | A * | 6/1997 | Delk et al. | 607/108 |
| 5,890,640 | A * | 4/1999 | Thompson | 224/630 |
| 5,902,073 | A * | 5/1999 | Eungard et al. | 405/187 |
| 5,954,253 | A * | 9/1999 | Swetish | 224/631 |
| 6,029,875 | A * | 2/2000 | Johnston | 224/417 |
| 6,055,975 | A * | 5/2000 | Gallagher et al. | 124/50 |
| 6,073,822 | A * | 6/2000 | Swensen de Vidals | 224/629 |
| 6,279,804 | B1 | 8/2001 | Gregg | |
| 6,325,262 | B1 * | 12/2001 | Thompson | 224/628 |
| 6,343,729 | B1 * | 2/2002 | Platta | 224/627 |
| 6,375,053 | B1 * | 4/2002 | Cecchinel | 224/267 |
| 6,460,746 | B1 | 10/2002 | Amram | |
| 6,474,523 | B2 | 11/2002 | Morrison et al. | |
| 6,478,464 | B1 * | 11/2002 | Miller | 383/76 |
| 6,607,108 | B2 | 8/2003 | Mydans | |
| 6,626,342 | B1 * | 9/2003 | Gleason | 224/633 |
| 7,210,605 | B2 * | 5/2007 | Willows et al. | 224/637 |
| 7,484,275 | B2 * | 2/2009 | Carroll et al. | 27/28 |
| 2003/0160079 | A1 * | 8/2003 | Nordstrom | 224/631 |
| 2005/0035170 | A1 * | 2/2005 | Sears et al. | 224/630 |
| 2006/0072857 | A1 * | 4/2006 | Revels | 383/35 |
| 2006/0218691 | A1 * | 10/2006 | Miller | 2/102 |
| 2007/0181241 | A1 * | 8/2007 | Kramer et al. | 156/73.4 |

FOREIGN PATENT DOCUMENTS

| | | | |
|---|---|---|---|
| FR | 2 778 825 | A1 | 11/1999 |
| GB | 2 152 575 | A | 8/1985 |
| WO | WO-91/05494 | A1 | 5/1991 |

* cited by examiner

III
24
20
42
12
34
34
10
28a
28a
72
72
18
18
26
28
72
72
30a
30a
30
30
40a
38a
40
35
16
38
38b
III
40b
36

Fig. 5
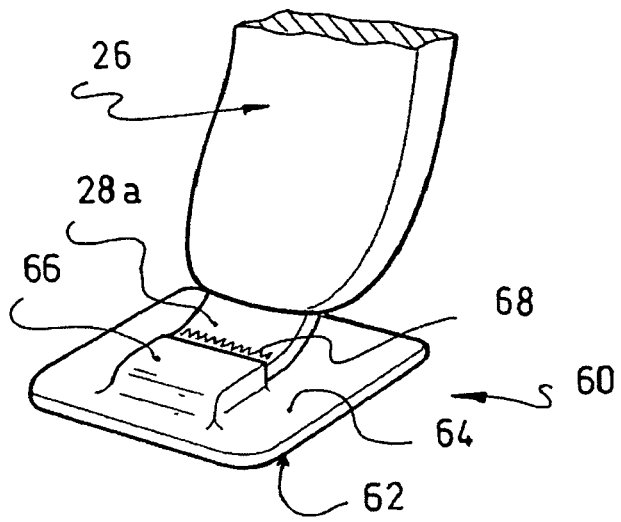
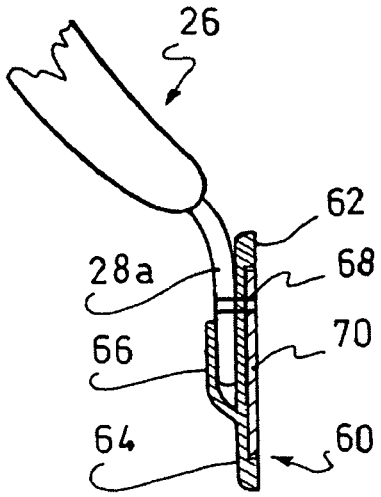
Fig. 6

BAG OR PACK, SUCH AS A BACKPACK

CROSS-REFERENCE TO RELATED APPLICATION

This application is based upon European Patent Application No. 05013246.3, filed on Jun. 20, 2005, the disclosure of which is hereby incorporated by reference thereto in its entirety and the priority of which is hereby claimed under 35 USC §119.

BACKGROUND OF THE INVENTION

1. Field of the Invention

The invention relates to bags or packs and, more particularly, to backpacks.

2. Description of Background and Relevant Information

Backpacks typically comprise a pack portion, usually made of relatively flexible (i.e., non-rigid) materials such as panels of textile fabrics, which forms a compartment adapted to receive a load to be carried. The pack portion comprises a back side which is positioned opposite the back of the user when it is worn. The backpack also has a carrying system which can comprise a pair of shoulder straps and possibly a hip-belt.

Being made of flexible materials, a loaded backpack tends to deform due to the volume and/or the weight of the load inside the pack. In particular, the back side can deform, which is most uncomfortable to the user.

In order to prevent such unwanted deformation, at least partly, it is known to provide the backpack with a stiffening frame along its back side. Such frames may be of different kinds. Some packs are equipped with one or more rigid rods (or stays) which are inserted in gussets attached to the back side. These rods are usually made of metal, plastic, or composite material, and they run substantially vertically along the back side. Other packs have a frame made of a sheet of semi-rigid or rigid material which is inserted in a gusset pocket of corresponding shape attached to the back side (usually on the inner side of the back side). Such sheet frame can be made of various materials, including plastic, composite materials, or rigid or semi-rigid foams. In the latter case, it can be provided that the sheet frame of semi-rigid foam is made of a folded sheet which is removably inserted in the gusset pocket and which can be removed to be used as a sleeping mattress for outdoor sports enthusiasts.

A sheet frame can also be reinforced by removable or non-removable rigid rods, and it can also be complemented by a layer of soft foam to provide additional carrying comfort for the user.

In most backpacks having a hip-belt, the carrying system is made to shift at least part of the weight of the load off the shoulder straps, down to the hip-belt, in order that at least part of the weight of the load is carried by the hips of the user rather than having his/her shoulders and back carry all the load. The stiffening frame participates in that load transfer by making a link between the shoulder strap attachment portions of the pack portion and its hip-belt attachment portions.

Nevertheless, conventional backpacks having a stiffening frame share in common that the frame is not an integral part of the pack and that this introduces undesirable movements and deformations between the frame and the relatively flexible material of the back side.

U.S. Pat. No. 4,750,654 discloses a backpack in which the flexible pack portion has no back side, the back side being made of layered structure comprising two layers of cellular synthetic resins (i.e., foams) over-molded on a fabric layer. The flexible pack portion is sewn onto the outer periphery of the back side structure.

Another problem with prior art backpacks is that most of them are not waterproof, not even water resistant. Waterproof bags are known in the art, such bags typically made of PVC-coated materials. Such waterproof bags are made by assembling panels by welding.

Welding is here opposed to gluing. Gluing requires the provision of an adhesive material between the two pieces to be assembled, whereas welding means that the surface of at least one of the pieces to be assembled (but preferably both) is melted to adhesively bond the two pieces. Both welding and gluing result in an adhesive bonding of the two pieces.

Welding operations are quite complicated as they require the use of complicated tools to press and heat the panels to be assembled along the necessary junction line. Such tools are even more complicated when it comes to welding along a non-straight line, and even worse when the junction line is three dimensional. On such PVC-coated bags, various handles and straps may be connected to the exterior surface of the bag. The technique used up to now has been to provide anchoring pads of plastic material, on which the handle or the strap is affixed, for example by sewing, and to weld the pads to the outer surface of the material.

Unfortunately, in some cases, the welding operation only permits welding along the periphery of the pad, not along its entire contacting surface. This is due to the presence of the strap or handle which is affixed to the pad, usually in the center of the pads, and which therefore makes it difficult to bring enough heat and pressure to the center of the pad to achieve welding.

Moreover, those bags have the undesirable feature of requiring PVC-coated or urethane-coated materials when it is now known that extensive use of PVC is undesirable in view of environmental issues. At least for this reason, urethane-coated waterproof bags are known in the prior art.

SUMMARY OF THE INVENTION

Therefore, it is an object of the invention to provide a pack using improved construction techniques to achieve yet unseen performance.

According to one aspect of the invention, a backpack is provided that includes:

- a pack portion including a back side made of flexible material;
- a carrying system directly or indirectly connected to the pack portion and comprising at least one carrying element;
- a frame connected to the pack portion;
- the frame comprising at least a rigid or semi-rigid sheet frame which is affixed to the back side of the pack portion by adhesive bonding.

According to another aspect of the invention, a backpack is provided having:

- a pack portion made of flexible material and including a back side;
- a carrying system directly or indirectly connected to the pack portion and comprising at least one shoulder strap connected by an upper end to an upper shoulder strap attachment portion of the back side of the pack portion;
- a frame connected to the pack portion, the frame extending along a region of the back side including at least an upper shoulder straps attaching portion and a lumbar portion of the back side;

the frame comprising at least a rigid or semi-rigid sheet frame which is affixed to the back side of the pack portion by adhesive bonding, and the upper end of the shoulder strap being connected to the corresponding shoulder strap attachment portion by adhesive bonding.

According to another aspect of the invention, a backpack is provided that includes:

a pack portion made of flexible material;

a carrying system connected to an outer surface of the pack portion at at least two distinct attachment portions;

a frame connected to the an inner surface of pack portion;

the frame comprising at least a rigid or semi-rigid sheet which is affixed to the pack portion by adhesive bonding and which underlies and extends between both attachment portions, and the carrying system being connected to the pack portion by adhesive bonding.

According to another aspect of the invention, a backpack is provided having:

a pack portion including a back side made of flexible material;

a carrying system directly or indirectly connected to the pack portion and comprising at least a pair of shoulder straps and a hip-belt;

a frame connected to the pack portion, the frame extending along a region of the back side including at least an upper shoulder straps attaching portion and a lumbar portion of the back side, the frame comprising at least a rigid or semi-rigid sheet which is affixed to the back side of the pack portion by adhesive bonding;

the hip-belt being connected to the pack portion by a pivot connection mechanism, and the pivot connection mechanism comprising at least one pivot part which is affixed to the back side of the pack by adhesive bonding.

According to another aspect of the invention, it is provided that the sheet frame is adhesively bonded to an inner surface of the back side of the pack portion, or to its outer surface. In the latter case, the carrying system can be indirectly connected to pack portion via the sheet frame.

According to other aspects of the invention, a backpack may be provided wherein:

the at least one carrying element comprises a pair of shoulder straps and a hip-belt, each shoulder strap being connected by an upper end and a lower end respectively to upper and lower shoulder strap attachment portions of the back side, and the hip-belt being connected to at least one hip-belt attachment portion of the back side, and the sheet frame extending along a region of the back side including at least the upper shoulder straps attachment portions and the hip-belt attachment portion of the back side;

the hip-belt is connected to the pack portion by adhesive bonding;

the sheet frame is substantially uniformly adhered along a substantial part of surface in contact with the back side of the pack portion;

the sheet frame is adhered to the back side using a thermo-activated adhesive film;

the sheet frame is adhered to the back side using a gluing compound which can comprise at least one interfacial layer between two adhesive films;

the sheet frame is unitary, or one-piece;

the sheet frame is subdivided in at least two sheet frame elements each adhered to the back side of the back portion;

the sheet frame elements are connected one to another by a rigid structure;

the sheet frame includes a sheet of plastic material;

the sheet frame includes a sheet of elastically compressible foam;

the sheet frame includes a sheet of plastic material adhesively bonded to a sheet of elastically compressible foam;

the sheet frame is reinforced by at least one rigid rod;

the pack portion is made of flexible waterproof material;

the pack portion is made of flexible waterproof material having an outer polyurethane coating having a peeling resistance of at least 10 pounds per inch according to Federal Test Method Standard 191A/5970;

the hip-belt is connected to the pack portion by a pivot connection mechanism;

the pivot connection mechanism comprises at least one pivot part which is affixed to the back side of the pack by adhesive bonding;

the pivot part which is affixed to the back side of the pack comprises a base part with a peripheral outer flexible flange;

the flexible flange is integral with the base part of the pivot part.

BRIEF DESCRIPTION OF THE DRAWINGS

Other aspects of the invention will be set forth in the following detailed specification which refers to the appended drawings in which:

FIG. 5 is a perspective back view showing the assembly of the upper end of a shoulder strap on the back side of the pack;

FIG. 6 is a vertical cut-out view along line VI-VI of FIG. 5;

DETAILED DESCRIPTION OF THE INVENTION

Figure 1:
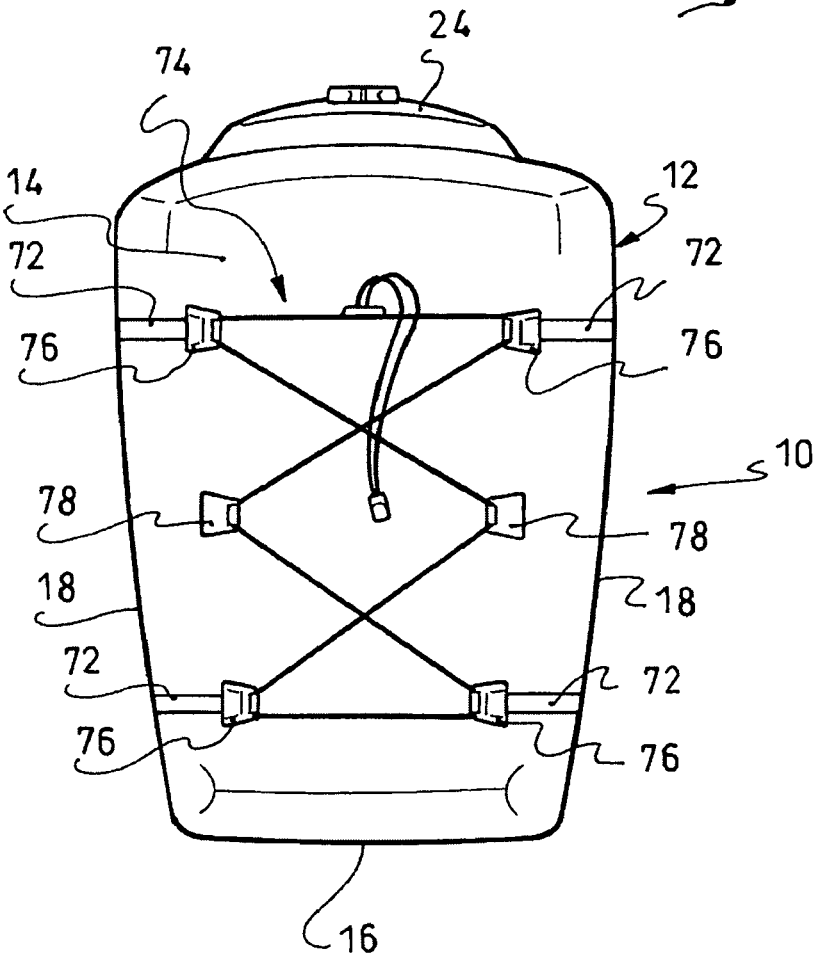
FIG. 1 is a front view of a backpack according to the invention, the opening of the pack being closed.
Figure 2:
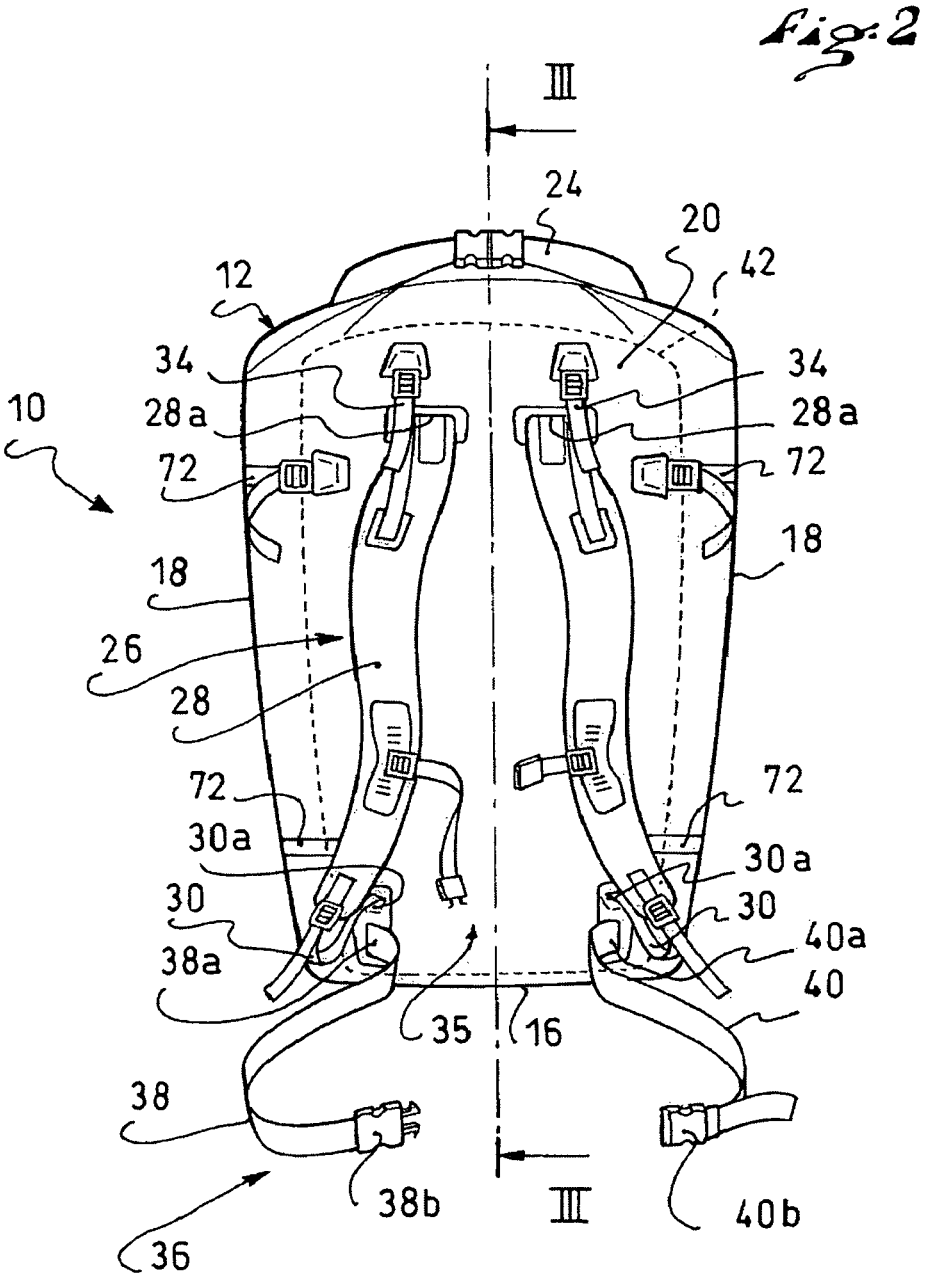
FIG. 2 is a back view of the backpack.
Figure 3:
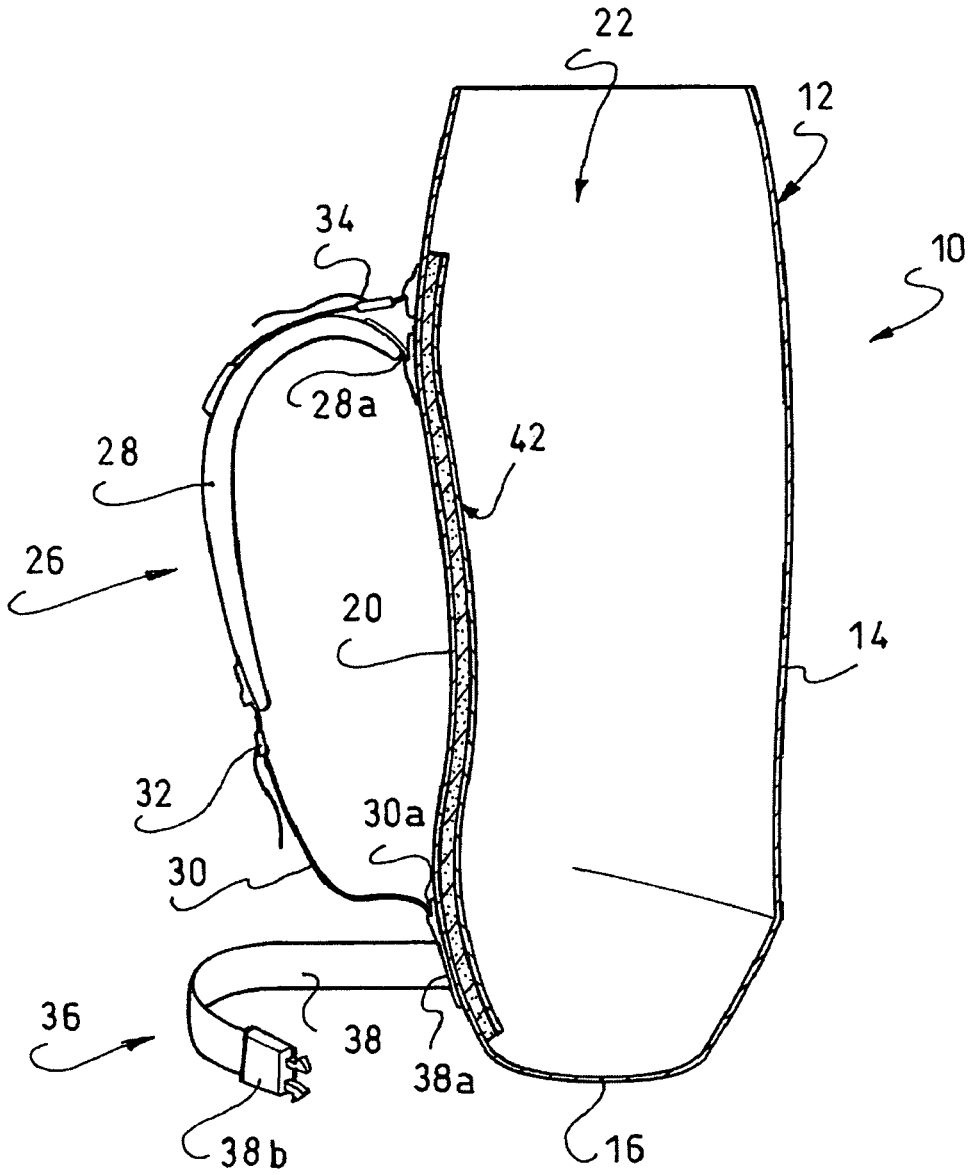
FIG. 3 is a vertical cut-out view of the backpack along line of FIG. 2, the top opening of the pack being open.

FIGS. 1 to 3 show a backpack 10 according to the invention, that is, a pack which is designed to be carried along the back of a user.

This backpack 10 has a pack portion 12 substantially entirely made of a flexible material, such as a woven textile fabric. In a preferred embodiment, this fabric is coated and/or laminated with at least one water-repellent, water-resistant, and/or water-proof material.

The pack portion basically exhibits a front side 14, a bottom side 16, two lateral sides 18 and a back side 20 which, when the backpack 10 is worn by a user, faces the back of the user.

The pack portion demarcates at least one inner compartment 22 of the pack which can accommodate a load to be carried. The inner compartment could have internal subdivisions, and the pack portion could also have outside pockets. The over-all shape of the pack portion 12 is designed both to provide a practical shape of the inner compartment 22, adapted to receive the objects which will constitute the load to be carried, and also to provide a bag which, when loaded, is comfortable for the user to carry. Although such shape will usually be substantially parallelepipedic, the exact shape will be far more complex. Such shape of the pack portion will be achieved through the tailoring of various panels of material having each a specific contour and assembled along well-defined junction lines. Such assembly can be performed by any known technique and especially by sewing. Preferably, in cases in which the pack portion material is water-resistant or waterproof, the assembly technique will be matched, for example by using taped seams which offer very good resistance to ingression of water.

In the embodiment shown in the figures, the pack portion has a top opening, which means that the main access to the internal compartment will be through its top opening. Indeed, as shown in FIG. 3, the upper part of the pack portion 12 is basically tubular and open towards the top. The closure system can be a roll-top type closure (as shown 24), or a simple hem-and-draw-cord type closure, possibly covered by an upper lid (not shown). Any known closure arrangement can be adapted. The invention is not limited to an open top backpack and can be implemented with other forms of backpacks, for example with a backpack having only a zippered opening in one of its sides, for example the front side.

The backpack shown in the figures has a carrying system on its back side.

In the embodiment shown, the carrying system first comprises a pair of shoulder straps 26 which are both attached to the pack portion at both ends. Each shoulder strap 26 is made of two strap parts: an upper strap part 28 which is attached by its upper end 28*a* to a corresponding attachment portion on the back side 20 of the pack portion 12, and a lower strap part 30 whose lower end 30*a* is attached to a corresponding attachment portion of the pack portion. The lower strap part 30 can be attached to the back side 20 of the pack portion (as in the example shown), but it can also be attached to other sides of the pack portion, for example either the lateral sides 18, the bottom side 16, or even the front side 14. The two strap parts 28, 30 are connected one to another through a buckle 32 which permits the effective length of the shoulder strap 26 to be adjusted. In the example shown, each shoulder strap 26 is equipped with an adjustable load stabilizing strap 34 whose lower end is attached on the shoulder strap 26 and whose upper end is attached to the back side 20 of the pack at a location above the upper strap attachment portion. By varying the length of such stabilizing strap 34, the user can move the load closer to or farther from his back.

Figure 7:
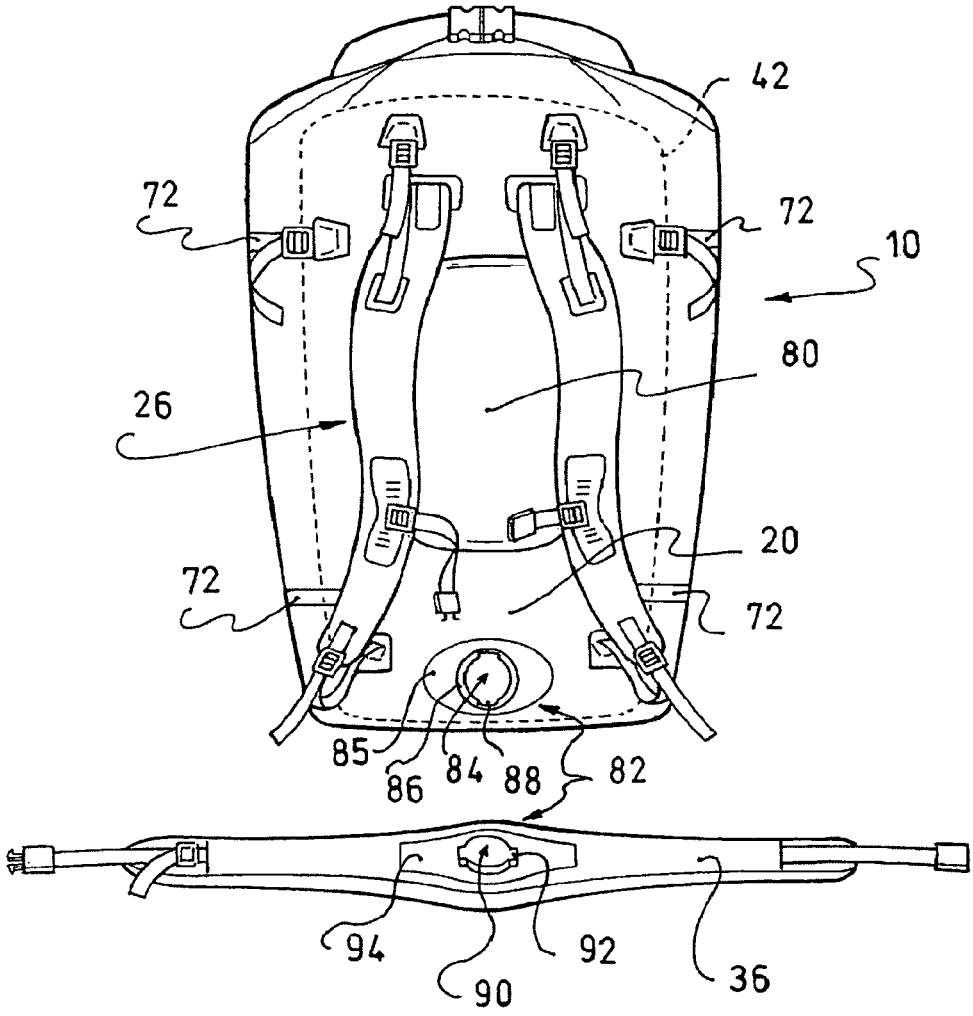
FIGS. 7 and 8 are rear views of a second embodiment of the invention having an improved hip-belt arrangement, respectively before and after the mounting of the hip-belt on the pack.
Figure 8:
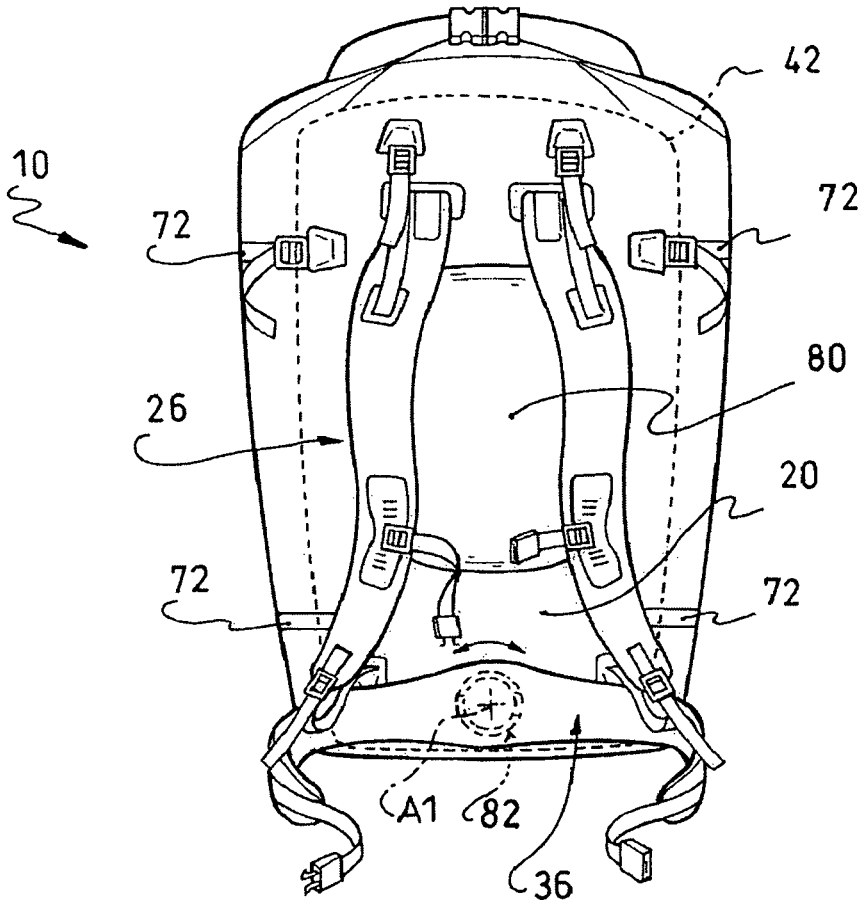

Especially for bags over 20 or 30 liters in capacity, the carrying system may also comprise a hip-belt 36 located in a lumbar portion 35 of the back side of the pack. As shown in FIGS. 1-3, a hip-belt 36 can be very simply made of two parts, viz., left and right strap parts 38, 40 each having a fixed end 38*a*, 40*a* attached to the back side 20 or to the corresponding lateral side 18 of the pack portion 12. The strap parts 38, 40 have then on their free ends a pair of corresponding fastening buckles 38*b*, 40*b* which enable the hip strap 36 to be closed and tightened around the hips of the user. With a simple hip strap 36, the lower portion of the back side of the pack (for example its lumbar portion 35) will come directly into contact with the back of the user. Such a simple hip strap 38, 40 will essentially help in stabilizing the bottom part of the pack laterally. A hip-belt 36 can also be made of a more comfortable cushioned structure, as shown in FIGS. 7 and 8, which is to be attached to the lumbar portion of the back side of the pack and which can be closed and tightened around the hips of the user. With such a hip-belt 36, one can achieve, in addition to the aforementioned stabilizing effect, a substantial load transfer from the shoulders of the user to his hips, making the carrying of large loads far more comfortable. As an alternative to the specific assembly described above, the invention encompasses the use of any of several different types of hip-belts, or hip-suspension assemblies, that are known to those skilled in the art.

A carrying system described above is the most efficient and comfortable for carrying large loads. But, for bags intended to carry lighter loads, a backpack made according to the invention can be envisioned having a simplified carrying system. Such system can have only the two shoulder straps, or it can even have one single shoulder strap, ideally then positioned diagonally across the back side of the bag. The invention can also be carried out on a lumbar pack, which is a kind of small backpack having only a hip-strap or hip-belt as a carrying system, and which a user carries on the lumbar part of his back.

As numerous backpacks of the prior art, the backpack according to the invention has a frame 42 which is connected to the pack portion. According to the invention, this frame comprises at least a rigid or semi-rigid sheet which is affixed to the back side of the pack portion by adhesive bonding.

It is a sheet frame in the sense that it has one dimension (its thickness) which is notably inferior to its two other dimensions (height and width), making it possible to define a main general plane of the frame (although the frame will most preferably be not perfectly planar, but slightly curved to follow at least partially the natural shape of the back of the user to enhance its ergonomics).

The frame is also rigid or semi-rigid, at least in comparison with the flexibility of the fabric from which the back side of the pack portion is made. The rigid or semi-rigid characteristic of the frame will also be assessed by the fact that it will be able to withstand substantial compressive forces directed along its main general plane without any important deformation, contrary to a flexible fabric for instance. On the other hand, despite its rigid or semi-rigid characteristic, the frame may be bendable. Such rigidity of the sheet frame can come from the rigidity of one specific component (e.g., a plastic sheet). But it can also come from the stacking of several components which are individually flexible but, when considered after assembly, show the required rigidity.

In the embodiment shown in the drawing, the frame 42 is a substantially rectangular in shape and extends along almost the entire surface of the back side 20 of the pack. In other words, with respect to the exemplary illustrated embodiment, the frame 42 has an outer surface area that is less than an outer surface area of the back side 20 of the pack. Such provision allows for the maximum performance of the frame, but one could also provide for a frame having smaller dimensions and/or different shapes. Indeed, the frame could cover only the upper part of the back side 20, or it could have a top part wider than a bottom part. It could also be substantially V-shaped or Y-shaped. It could also have one or several apertures in regions where no rigidification is needed. It could have the shape of an inverted A.

According to one aspect of the invention, the frame is connected to the back side 20 of the pack. Depending on the nature of the frame and on the nature of the flexible material of the back side, different adhesive bonding techniques can be used. If the materials are compatible, one can envision that the frame is affixed to the back side by welding, for example ultrasonic or radio-frequency welding.

In most cases the adhesive bonding will be achieved through the use of an adhesive material such as glues or glue-containing compounds. Many types of glues can be used, such as, for example, polyurethane based glues. Those glues can be in the form of self-standing films or in liquid form. They can be thermo-activated glues, e.g., hot-melt glues.

Figure 4:
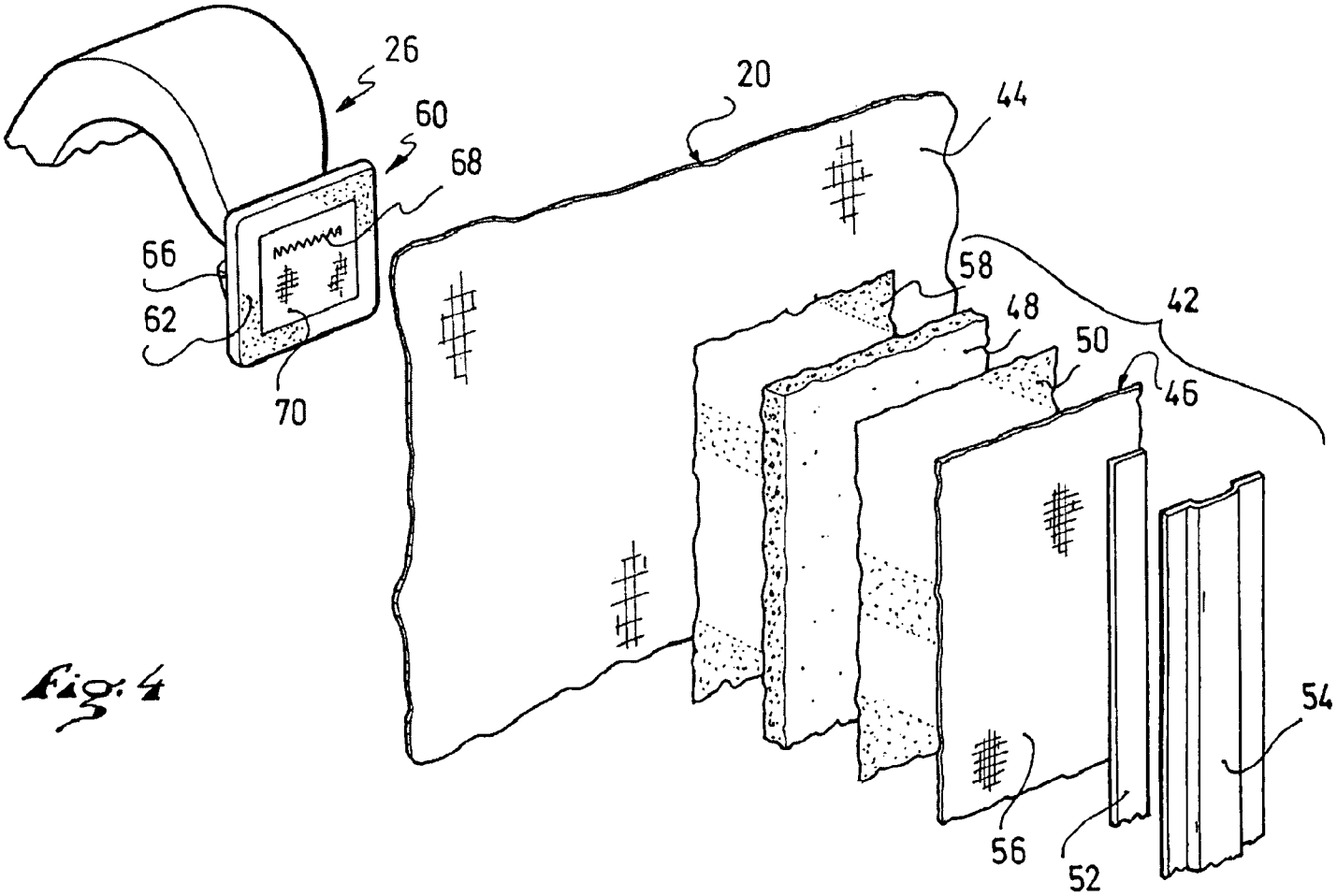
FIG. 4 is an exploded vertical cut-out view showing one embodiment of an adhesively bonded sheet frame according to the invention.

An exemplary embodiment of this innovative frame 42 is shown at FIG. 4. In this embodiment, the frame 42 is adhered to the inner surface 44 of the back side 20 of the pack portion 12. As mentioned above, the back portion is for example made of a Nylon-based woven textile which can be laminated on its inner surface with a water-impermeable film, for example a polyurethane film. It can also be coated on its outer surface with a water-repellent or water-resistant coating, for example a polyurethane coating.

The frame 42 has a first main component comprising a structural sheet 46. It can be made of any semi-rigid or rigid material, such as plastics, composite materials, metal, etc. . . . It will preferably have the appropriate thickness to exhibit enough strength without excessive weight. Preferably, this structural sheet will be conformed to the shape on the back of a user, either by thermoforming or by appropriately shaping a reinforcing stay, if used to reinforce the frame 42 (such as stay(s) 52, mentioned below). Its shape may be modified (e.g., by thermoforming or by reshaping the stay(s)) to be better adapted to a specific user.

The frame also has a sheet of foam 48 which is to be sandwiched between the structural sheet 46 and the back side 20. The sheet of foam will advantageously be made of an elastic foam, which will provide extra carrying comfort to the bag and abrasion-resistance around the perimeter of the structural sheet. Nevertheless, rigid or semi-rigid foams may also be used. Preferably, the structural sheet 46 and the foam sheet 48 are joined one to another, along their entire contacting surface or desirably at least along a substantial portion thereof, by adhesive bonding. As shown in FIG. 4, one may use a thermo-activated adhesive, such as a film of hot-melt adhesive, or a gluing compound 50 to glue the foam sheet 48 to the structural sheet 46. The gluing compound 50 may, for example, be made of two or more films of hot-melt adhesive, possibly of different compositions to adapt to the specific materials of the structural sheet 46 on one side and of the foam sheet 48 on the other side. The gluing compound may also have an interfacial layer between two adhesive films. The interfacial layer is for example a fabric layer. When using a thermo-activated film, it will be necessary to select films which have an activating temperature (melting temperature for a hot-melt film) inferior to the temperature at which the flexible material of the back side 20 may start being damaged.

In the example shown, the frame 42 is reinforced by one or several rigid stays 52 (or rods, only one depicted in FIG. 4). In the example shown, the stay 52 is arranged substantially vertically and it is received in a gusset 54, or pocket, which is attached on the internal surface 56 of the structural sheet, for example attached by adhesive bonding along its two vertical borders. Preferably, the gusset 54 is open at its top end, and the stay 52 is mounted in the gusset so as to be removable by sliding it out of the gusset. A short flap could be affixed at one end to the structural sheet and extend over the end of the gusset to retain the stay in place, the other end of the flap having a closure, such as a snap or a Velcro® fastener, e.g., to permit access to the stay. The stay 52 can be made of aluminium or other metal, rigid plastics, fiber-reinforced composites, including sandwich type composites, etc. . . . Instead of being inserted in a gusset, the stay could be directly glued onto the structural sheet 46.

According to the invention, the frame 42 (here comprising the structural sheet 46, the foam sheet 48 and one or several stays 52) is attached to inner surface 44 of the back side by adhesive bonding. In the example shown, the adhesion is obtained using a holt-melt film adhesive 58, or using a gluing compound as described above. Of course, other types of adhesives can be used.

The frame 42 could also be constructed as a sandwich structure having a spacing layer (for example made of foam) between two structural sheets (of the same material or of different materials).

Preferably, the frame 42 will be adhered to the back side 20 along an adhesion zone covering their entire contacting surface, or at least a substantial portion of the contacting surface. In the latter case, the adhesion zone will preferably be continuous. It may for example show a regular pattern of patches without any adhesive bonding (for example to save some weight of the gluing compound). Most importantly, the adhesion zone will preferably cover the parts of the back side where elements of the carrying system are anchored. In other words, the adhesion zone will at least correspond to the various attachment portions for the carrying system. Most preferably, at least at its locations corresponding to those attaching portion portions, the frame will be substantially flat so as to achieve a continuous and integral contact leaving no void between the frame and the material of the pack portion along those locations. Indeed, such continuous and integral contact will considerably reinforce the mechanical strength of pack the portion under the attachment portions.

Indeed, as can be seen in FIGS. 2 and 3, the back side attachment portions for the ends 28*a*, 30*a* of the shoulder straps 26 and for the ends 38*a*, 40*a* of the hip-belt straps on the back side 20 of the pack portion 12 are portions of the back side which are located within the area covered by the frame 42. In an exemplary embodiment, described below in connection with reference to FIGS. 4, 5, and 6, the attachment portions of the back side 20 of the pack portion 12 cover, i.e., are opposite, the anchoring parts of the straps, such as anchoring bases 60 of the ends of the shoulder straps 26. Stated another way, the adhesive bond between the sheet frame and the back side of the pack portion has an area that is opposite, or faces, at least the attachment portions of the back side of the pack portion, which is also opposite, or races, the anchoring parts of the shoulder straps. Similarly, the attachment portions for the stabilizing straps 34 on the back side 20 are also within the periphery of the frame 42. Therefore, it is advantageous to make sure the adhesion zone of the frame 42 covers, i.e., is opposite, or faces, the corresponding attachment portions of the back side 20 of the pack portion 12 of the backpack 10. By such provision, the frame 42 makes a direct mechanical linkage between each element of the carrying system. Stated another way, an imaginary straight line extending through the anchoring base 60 from the outside to the inside of the compartment 22 extends through the back side 20 of the pack portion 12 of the backpack, through the adhesive bond between the back side 20 and the frame 42, and then through the thickness of the frame 42. As another alternative, the anchoring base 60 and the adhesive bond between the back side 20 and the frame 42 are an equal distance from a reference point, such as the top edge of the pack portion. In addition, as can be seen in FIG. 3, at its upper end, the frame 42 terminates above the attachment of the upper end of the load stabilizing strap 34 to the pack portion 12. The carrying forces transferred between the carrying elements being directed parallel to the general plane of the frame, the frame can be considered substantially rigid with respect to such forces. Moreover, because the frame 42 is adhesively bonded to the back side 20, therefore inhibiting any undesirable movement between the back side 20 and the frame 42, such linkage is geometrically perfectly stable and well-defined. It will not be affected by any unwanted displacement of the various elements, and will therefore guarantee a very precise transfer of loads between the backpack and its user. Such precision is crucial in avoiding unwanted movements of the backpack altogether relative to the user. Those unwanted movements can create a certain amount of unbalance to the user, and it is therefore a great advantage of the backpack according to the invention that such movements be minimized.

Therefore, from a load stability standpoint, it will be advantageous to have a unitary sheet frame 42 underlying all attachment portions of the carrying system.

But, in some cases, it may be sufficiently satisfactory that the adhesively bonded frame 42 underlie only part of the back side 20, and not all the attachment portions.

One possibility would therefore be to have the adhesively bonded frame underlie and extend between the attachment portions of the upper and lower ends of the shoulder straps, and/or underlie and extend between the attachment portions of the upper ends of the shoulder straps and of a hip-belt arrangement, the adhesion zone of the frame to the pack corresponding at least to the attachment portions.

In other instances, it may be useful to have the sheet frame made of several parts each independently adhesively bonded to the pack portion. For example, it may be useful to have two separate sheet frames of the left part and for the right part of the pack.

In other cases, it may be useful to have the sheet frame divided into two or more separate parts along substantially horizontal partition lines. In such a case, it will be preferable to make sure that the sheet frame parts are located adjacent one to another so that their lateral borders along the partition lines come into abutment one with the other. In such a case, one can provide that such multi-part sheet frame can be united by a rigid structure, such as one or several common stays slidably inserted in corresponding gussets arranged on the frame parts. With such a construction, the sheet frame will be foldable when the stays are removed, and will recover some rigidity altogether when the stays are in place.

Another innovative aspect of the backpack according to the invention is that at least some of the elements of the carrying system are attached to the pack portion 12 by adhesive bonding, and more specifically by gluing, i.e., by the provision of a specific adhesive material or compound.

In FIGS. 4, 5, and 6 is shown more precisely how the upper end 28*a* of a shoulder strap 26 can be attached to the pack portion by gluing.

In the embodiment shown, the upper end 28*a* of the shoulder strap 26 is made of a textile web or strap and it is fixed on an anchoring part. In the illustrated embodiment, the anchoring part takes the form of an anchoring base 60. The anchoring base 60 is made of flexible plastic material (for example polyurethane) having a back surface 62 facing the pack portion 12, and a front surface 64 on which the upper end 28*a* of the shoulder strap 26 is fixed by stitching. More precisely, one can see that the anchoring base 60 has a housing 66 formed on its front surface 64 and adapted to receive and hide the extremity of the upper end 28*a* of the shoulder strap. The housing 64 is closed in all but one direction, only open along a direction parallel to the base for introduction of the extremity of the strap 28*a* in the housing. The stitching line 68 for holding the strap 28*a* on the base 60 is made just in front of the housing's opening. To increase the strength of the stitching 68 (specifically to avoid any risk of tearing of the base material), the back surface 62 of the base is backed with a piece of woven fabric 70, and the stitching is done through the upper end strap 28*a*, through the base 60, and through the woven fabric reinforcement 70. Preferably, the fabric reinforcement 70 is located in a recess which is provided in the back surface 62 of the anchoring base 60, so that the fabric reinforcement 70 is flush with the back surface 62.

According to one aspect of the invention, the anchoring base 60 is then affixed to the outer surface of the back side 20 of the pack portion 12 by gluing.

In order to prevent any risk of the shoulder strap 26 peeling off, it is provided that the anchoring base 60 is glued at a location of the back side 20 where the reinforcing frame 42 is also adhered to the back side 20 (on its inner side). Therefore, the frame underlies and is directly bonded to the attachment portion (of the back side 20 of the pack portion 12) for the shoulder strap. This prevents any severe bending of the substrate (i.e., the back side fabric 20) on which the anchoring base 60 is glued, which severe bending would promote peeling off near the edges of the base 60. Another advantageous provision is to make sure the edges of the base 60 are sufficiently thin and flexible to follow easily any residual bending of the substrate without exerting too much peeling off stress on the glue. Yet another advantageous provision is to use an adequate substrate. Indeed, especially when it comes to affixing a shoulder strap by adhesive bonding, it is necessary to use a substrate which is specifically designed therefor. For example, if the substrate is a fabric coated or laminated on its outer side (for example, a woven textile coated with a water-repellent or water resistant polyurethane coating), the coating (or laminate) should have an adhesion resistance to the base fabric, or peeling resistance, of at least 10 pounds per inch (10 lbs/in; approximately 68947 N/m2) according to Federal Test Method Standard 191A/5970 (or according to corresponding ASTM Standard D-751), although preferably about 18-20 lbs/in or greater is contemplated according to the invention. In practice, a peeling resistance of about 30 lbs/in, and slightly higher, has been achieved using a polyurethane coating.

In the embodiment shown, each element of the carrying system is affixed to the pack portion through the gluing of an anchoring base 60 described above: the upper and lower ends 28*a*, 30*a* of the shoulder straps 26, as well as the hip-belt straps 38, 40 and the stabilizing straps 34. Some of the elements can share the same anchoring base, as for example the lower end 30*a* of the shoulder straps and the corresponding hip-belt strap part 38*a*, 40*a*. Moreover, the anchoring base of each element is glued at a location of the back side 20 where the reinforcing frame 42 is also adhered to the back side (on the inner side).

One can also see in FIGS. 1 and 2 that the same affixing technology can be used for other accessories on the backpack, as for example for the compression straps 72 and the front chock-chord system 74. Those accessories, not being exposed to important loads, can be affixed by gluing on parts of the pack portion which are not reinforced by the frame. They can also use much smaller anchoring bases 76, 78, and can also share such anchoring bases 76.

In FIGS. 7 and 8 is illustrated a second embodiment of a backpack according to the invention. This second embodiment only differs from the first embodiment by the presence of a comfort pad 80 which is glued on the outer surface of the back side 20 of the pack, and by the presence of a hip-belt 36 which is connected to the back side 20 of the pack portion by a disconnectable pivoting connection mechanism 82 which is very schematically depicted.

The pivoting connection mechanism 82 has a socket 84 which is affixed to the back side 20 of the pack portion, in a lumber part thereof. The socket 84, another exemplary embodiment of which is shown on FIGS. 9 and 11, can be affixed by any known technique, but it will be most advantageously be affixed by adhesive bonding, e.g. by gluing. The socket has a base 85, the size of which can be adjusted to provide enough adhesion surface, and an annular rim 86 with a number of internal radial grooves 87 (only two in FIG. 7, but four in FIGS. 9 and 11). Each radial groove 87 extends around a certain angle. The rim 86 has a corresponding number of notches 88, each at one extremity of the corresponding groove 87.

Figure 9:
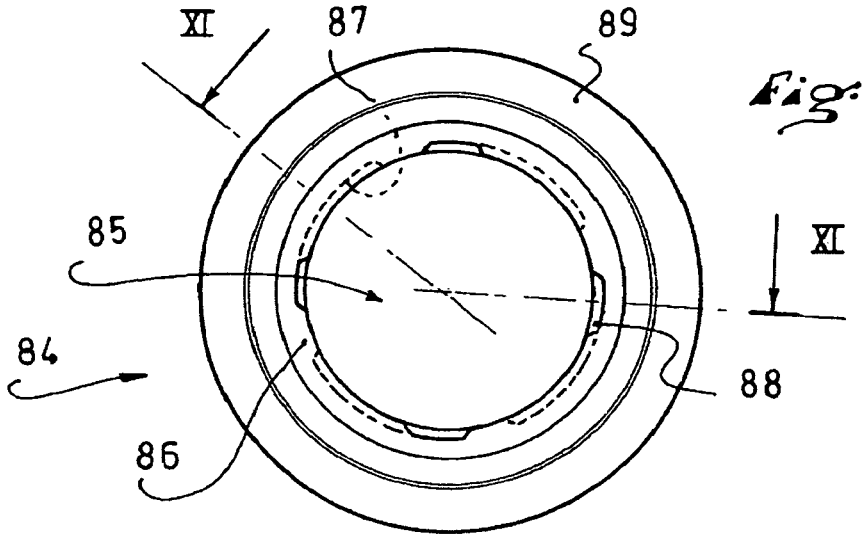
FIGS. 9 and 10 show the two parts of a hip-belt pivoting connection mechanism.
Figure 11:
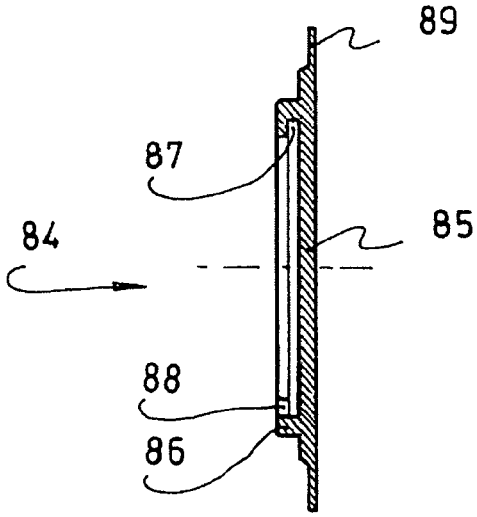
FIG. 11 is a cut-out along line XI-XI of FIG. 9.

As shown in FIG. 7, the pivoting connection mechanism 82 has, affixed to the hip-belt 36, a cylindrical fitting 90 (adapted to be axially fitted within the annular rim 86 so as to form a pivoting connection) with radial studs 92. Another exemplary embodiment of a fitting 90 is shown in FIGS. 9 and 11. The studs 92 correspond in shape and in number to the notches 88 of the rim 86, so that they can be introduced axially through the notches 88, and, by a proper rotation, be inserted in the radial grooves 87 of the socket 84 to prevent the axial release of the fitting 90 from the socket 84, while allowing a rotation of the fitting relative to the socket.

Figure 10:
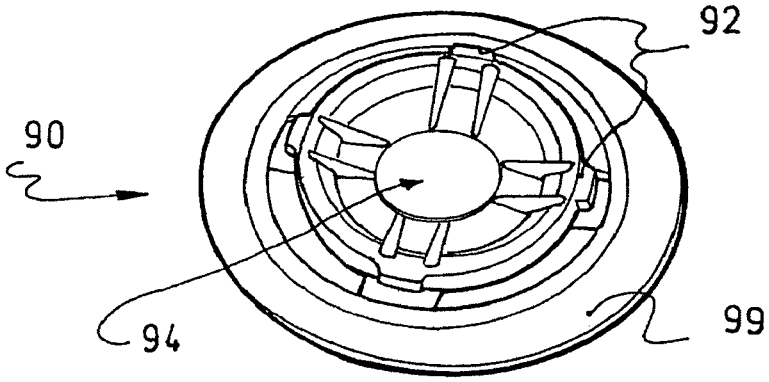

The fitting 90 also has a base 94 by which it can be affixed to the cushioned hip-belt 36, for example by gluing. As shown more specifically in FIGS. 9 to 11, the base parts 85, 94 of the socket 84 and of the fitting 90 preferably has an outer peripheral flange 89, 99 which is flexible. Preferably, the flexible flange 89, 99 of both parts will be integral with the base, each connection part being preferably molded in one piece from plastic material. In such a case, the outer flanges will be made sufficiently thin to be flexible, while the rest of the part is substantially rigid. The flange will preferably be a mere extension of the base part so that they exhibit a single flush back surface, adapted to lie against the corresponding element of the pack. The flexible flange portion 89, 99 of the parts will be very important if those parts are assembled by adhesive bonding because they will prevent or at least reduce the risk of peeling off.

Many types of known alternative pivoting connections could be used, and one skilled in the art would easily figure out a convenient embodiment. More complex connecting mechanisms could also be used to link the hip belt to the pack, for example mechanisms with dual pivoting rods. In addition, the socket and the fitting could have interchanged positions on the hip-belt and on the pack.

The above cushioned hip-belt 36 and its pivoting connection mechanism 82 is particularly relevant in the context of the invention where the back side 20 of the pack, and particularly its lumbar part, is reinforced by an adhesively bonded frame 42. Indeed, the presence of the frame 42 in the lumbar part of the pack, where the hip-belt 36 is also connected the pack, will permit a very stable and precise fixing of the pivot mechanism 82. If the latter is also adhesively bonded to the pack, there will be no parasitic lateral or vertical movement between the hip-belt, the frame 42, and the shoulder straps 26, achieving superior carrying ability. The hip-belt 36 can also be perfectly positioned and tightened around the hips of the user, while the pivot mechanism 82 will provide the adequate freedom of movement between the shoulder straps 26 and the hip-belt 36 for the pack to follow the movements of the user's back.

Figure 3A:
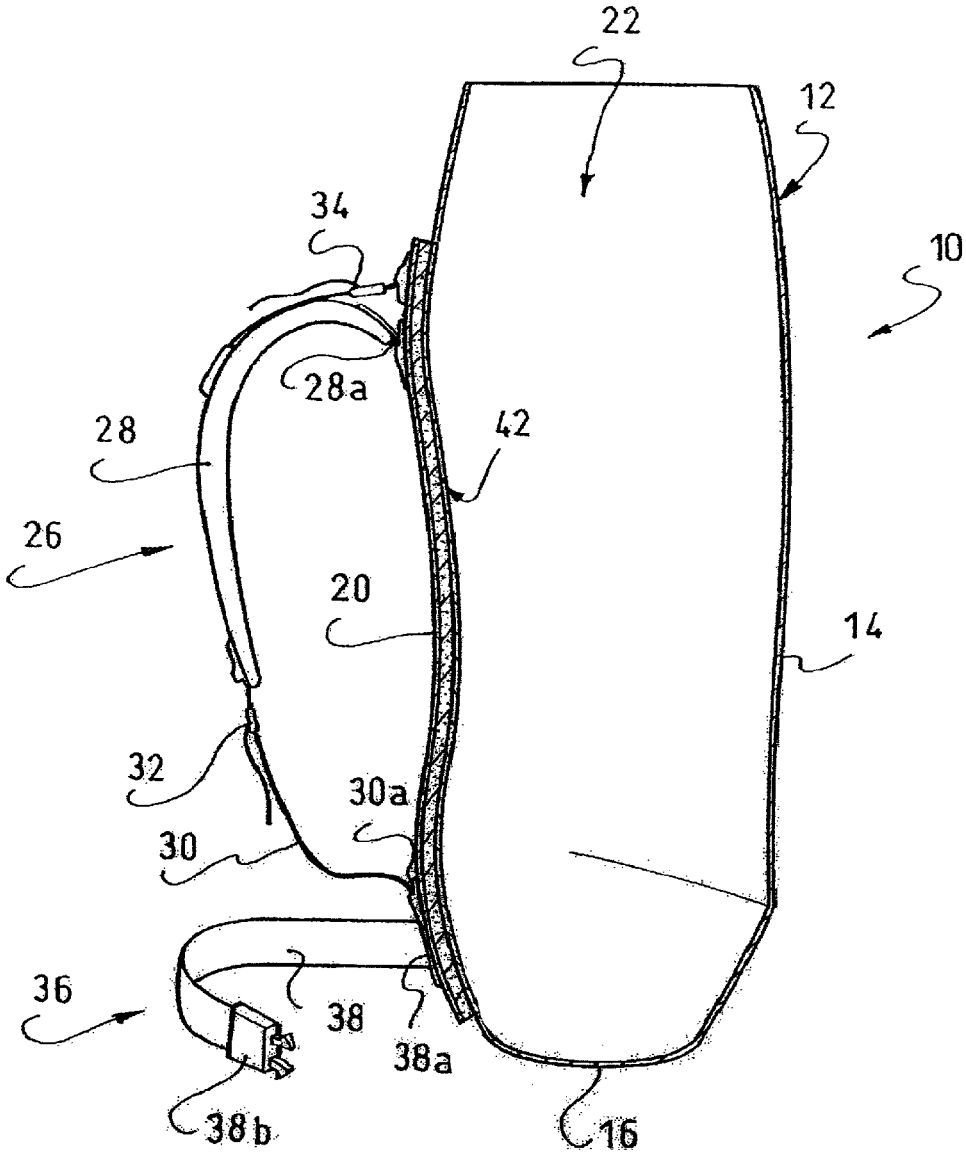
FIG. 3*a* is a view like that of FIG. 3, but illustrating a variation of the backpack of FIG. 3.

In the embodiments described above, the frame is adhesively bonded to the inner surface of the back side of the pack. Nevertheless, it is also within the scope of the invention to provide that the frame be adhesively bonded to the outer surface, as shown in the alternative embodiment of FIG. 3*a*. In such a case, it would be interesting from a manufacturing standpoint to have at least part of the carrying system (and of other accessories) affixed to the frame and indirectly affixed to the pack instead of having them directly affixed thereto.

In the above described embodiments, it has been chosen that the frame, the carrying system, and all other accessories are affixed to the pack portion by adhesive bonding. This is of course very interesting in terms of limiting or inhibiting water ingressions into the pack. Indeed, this allows to drastically diminish the number and the length of assembling stitches, which are always major water ingression points. This is of course desirable when the construction of a waterproof bag is pursued, because it eliminates the need to cover the corresponding stitches with a seam tape, saving both the additional weight of the tape and the extra manufacturing time. But it is also desirable in a conventional non-waterproof bag where non-waterproof fabrics are used. Indeed, by minimizing those major water ingression points, and by simply providing a water-repellent finish to the fabric, one can achieve a bag which is not waterproof, but which will nevertheless prevent major ingressions of water for a certain amount of time, which is often sufficient for ordinary uses.

As mentioned above, different adhesive bonding techniques can be used in the invention, such as the use of glues, glue-containing compounds, and such as the use of ultrasonic, radio-frequency, or other types of welding. Two or more elements adhesively bonded, according to the invention, can be referred to as being "non-removably adhesively" bonded together. In the sense used herein, the term "non-removable" means that separation of such connected elements requires reversing or otherwise undoing an adhesive bond affixing together such connected elements, in contrast to connected elements that are "removably" affixed, which would not require a reversal or an undoing of an adhesive bond.

The invention claimed is:

1. A backpack comprising:

a pack portion made of flexible material and including a back side, an inner compartment to accommodate a load to be carried during use of the backpack, the inner compartment being demarcated at least in part by the back side;

a carrying system directly or indirectly connected to the pack portion and comprising at least one shoulder strap connected by an anchoring part of an upper end to an upper shoulder strap attachment portion of the back side of the pack portion;

a frame connected to the pack portion, the frame extending along a region of the back side of the pack portion including at least the upper shoulder strap attachment portion and a lumbar portion of the back side of the pack portion;

the frame comprising at least a rigid or semi-rigid sheet, the sheet being more rigid than the flexible material of the pack portion, and a sheet of elastically compressible foam;

the frame being non-removably adhesively bonded to the back side of the pack portion by an adhesive bond, in the form of a thermo-activated glue or glue-containing compound, between the frame and the back side of the pack portion at the shoulder strap attachment portion of the back side of the pack portion;

an adhesive bond between the anchoring part of the upper end of the shoulder strap and the shoulder strap attachment portion of the back side of the pack portion, in the form of a thermo-activated glue or glue-containing compound, thereby non-removably adhesively bonding the anchoring part of the upper end of the shoulder strap directly or indirectly to the shoulder strap attachment portion of the back side of the pack portion.

2. A backpack according to claim 1, wherein:

the carrying system comprises a pair of shoulder straps, each shoulder strap being connected by an upper end and a lower end, respectively, to upper and lower shoulder strap attachment portions of the back side of the pack portion;

the carrying system further comprises a hip belt, the hip-belt being connected to at least one hip-belt attachment portion of the back side of the pack portion;

the frame extends along a region of the back side of the pack portion including at least the upper shoulder straps attachment portions and the hip-belt attachment portion of the back side of the pack portion.

3. A backpack according to claim 2, wherein:

a part of the hip-belt is non-removably adhesively bonded to the back side of the pack portion.

4. A backpack according to claim 1, wherein:

the frame is non-removably adhesively bonded to an inner surface of the back side of the pack portion.

5. A backpack according to claim 1, wherein:

at least at the shoulder strap attachment portion of the back side of the pack portion, the rigid or semi-rigid sheet of the frame is substantially flat; and a continuous and integral contact, with no void, exists between the adhesive bond of the frame and the adhesive bond of the shoulder strap attachment portion of the back side of the pack portion.

6. A backpack according to claim 1, wherein:

the frame has an outer surface area that is less than an outer surface area of the back side of the pack portion of the backpack.

7. A backpack according to claim 1, wherein:

the adhesive bond between the frame and the back side of the pack portion bonds the frame to an inner surface of the back side of the pack portion, the carrying system being directly connected to the pack portion.

8. A backpack according to claim 1, wherein:

the adhesive bond between the frame and the back side of the pack portion bonds the frame to an outer surface of the back side of the pack portion, the carrying system being indirectly connected to the pack portion.

9. A backpack according to claim 1, wherein:

the flexible material of the pack portion is a fabric.

10. A backpack according to claim 1, wherein:

the frame further comprises a sheet of elastically compressible foam;

the rigid or semi-rigid sheet is a sheet of plastic material adhesively bonded to the sheet of elastically compressible foam.

11. A backpack comprising:

a pack portion made of flexible material and including a back side, an inner compartment to accommodate a load to be carried during use of the backpack, the inner compartment being demarcated at least in part by the back side;

a carrying system directly or indirectly connected to the pack portion and comprising at least one carrying strap;

the carrying strap comprising an anchoring part for anchoring the carrying strap to a shoulder strap attachment portion of the back side of the pack portion;

a thermo-activated glue or glue-containing compound between the anchoring part of the carrying strap and the shoulder strap attachment portion of the back side of the pack portion;

a frame connected to the pack portion;

the frame comprising: at least a rigid or semi-rigid sheet, the sheet being more rigid than the flexible material of the pack portion, and a sheet of elastically compressible foam;

said frame being adhesively bonded to the back side of the pack portion by an adhesive bond between the frame and the back side of the pack portion;

the adhesive bond between the sheet and the back side of the pack portion comprising a thermo-activated glue or glue-containing compound between the frame and the back side of the pack portion;

the glue or gluing compound between the anchoring part of the carrying strap and the shoulder strap attachment portion of the back side of the pack portion being positioned at a distance from a reference point on the pack portion equal to a distance from the reference point the adhesive bond between the frame and the back side of the pack portion is positioned.

12. A backpack according to claim 11, wherein:

the glue or glue-containing compound between the frame and the back side of the pack portion comprises at least one interfacial layer between two adhesive films.

13. A backpack according to claim 11, wherein:

separation of the frame and the back side of the pack portion requires undoing the adhesive bond between the frame and the back side of the pack portion.

14. A backpack according to claim 11, wherein:

the frame is adhesively bonded, by means of the thermo-activated glue or glue-containing compound, to an inner surface of the back side of the pack portion.

15. A backpack according to claim 11, wherein:

the flexible material of the pack portion is a fabric.

16. A backpack according to claim 11, wherein:

the thermo-activated glue or glue-containing compound between the sheet and the back side of the pack portion is a thermo-activated adhesive film.

17. A pack comprising:

a pack portion made of flexible material, the pack portion including a back side and an inner compartment to accommodate a load to be carried during use of the backpack, the inner compartment being demarcated at least in part by the back side;

a carrying system comprising a strap connected to an outer surface of the pack portion at at least two distinct attachment portions of the outer surface of the pack portion;

a frame connected to the an inner surface of pack portion;

the sheet comprising at least a rigid or semi-rigid sheet, the frame being more rigid than the flexible material of the pack portion, and a sheet of elastically compressible foam;

the frame being affixed to the pack portion by an adhesive bond between the frame and the pack portion and which underlies and extends between both attachment portions;

the adhesive bond between the frame and the pack portion comprising a thermo-activated glue or glue-containing compound;

the strap of the carrying system comprising an anchoring part connected to the pack portion by an adhesive bond between the carrying system and at least one of the attachment portions of the outer surface of the pack portion;

the adhesive bond between the carrying system and the at least one of the attachment portions of the outer surface of the pack portion comprising a thermo-activated glue or glue-containing compound;

the anchoring part of the carrying system and the adhesive bond between the frame and the back side of the pack portion being positioned an equal distance from a reference point on the pack portion.

18. A pack according to claim 17, wherein:

the pack portion is made of flexible waterproof material.

19. A backpack according to claim 18, wherein:

the flexible waterproof material of the pack portion comprises a plurality of panels joined together along junction lines protected for resistance to ingression of water.

20. A pack according to claim 17, wherein:

the pack portion is made of flexible waterproof material having an outer polyurethane coating having a peeling resistance of at least 10 pounds per inch according to Federal Test Method Standard 191A/5970.

21. A pack according to claim 17, wherein:

separation of the frame and the back side of the pack portion requires undoing the adhesive bond between the frame and the back side of the pack portion.

22. A pack according to claim 17, wherein:

the flexible material of the pack portion is a fabric.

23. A backpack comprising:

a pack portion made of flexible material, the pack portion including a back side and an inner compartment to accommodate a load to be carried during use of the backpack, the inner compartment being demarcated at least in part by the back side;

a carrying system directly or indirectly connected to the pack portion and comprising at least a pair of shoulder straps and a hip-belt;

a frame connected to the pack portion, the frame extending along a region of the back side including at least an upper shoulder straps attaching portion and a lumbar portion of the back side of the pack portion;

the frame comprising at least a rigid or semi-rigid sheet, the sheet being more rigid than the flexible material of the pack portion, and a sheet of elastically compressible foam;

a thermo-activated glue or glue-containing compound between an anchoring part of one of the pair of shoulder straps and the shoulder straps attaching portion of the frame;

the frame being affixed to the back side of the pack portion by an adhesive bond between the frame and the back side of the pack portion;

the glue or glue-containing compound between the anchoring part of one of the pair of shoulder straps and the shoulder straps attachment portion of the back side of the pack portion being positioned at a distance from a reference point on the pack portion equal to a distance from the reference point the adhesive bond between the frame and the back side of the pack portion is positioned;

the hip-belt being connected to the pack portion by a pivot connection mechanism;

the pivot connection mechanism comprising at least one pivot part which is affixed to the back side of the pack portion by an adhesive bond between the pivot part and the back side of the pack portion at the lumbar portion of the back side of the pack portion.

24. A backpack according to claim 23, wherein:

the pivot part which is affixed to the back side of the pack comprises a base part with a peripheral outer flexible flange.

25. A backpack according to claim 24, wherein:

the flexible flange is integral with the base part of the pivot part.

26. A backpack according to claim 23, wherein:

separation of the frame and the back side of the pack portion requires undoing the adhesive bond between the frame and the back side of the pack portion.

27. A backpack according to claim 23, wherein:

the frame is adhesively bonded, by means of the thermo-activated glue or glue-containing compound, to an inner surface of the back side of the pack portion.

28. A backpack according to claim 23, wherein:

the flexible material of the pack portion is a fabric.

29. A backpack comprising:

a pack portion made of flexible material and including a back side, an inner compartment to accommodate a load to be carried during use of the backpack, the inner compartment being demarcated at least in part by the back side;

a carrying system directly or indirectly connected to the pack portion and comprising at least one shoulder strap connected by an anchoring part of an upper end to an upper shoulder strap attachment portion of the back side of the pack portion;

a frame connected to the pack portion, the frame extending along a region of the back side including at least the upper shoulder strap attachment portion and a lumbar portion of the back side;

the frame comprising at least a rigid or semi-rigid sheet frame, the sheet being more rigid than the flexible material of the pack portion, and a sheet of elastically compressible foam;

the frame being adhesively bonded to the back side of the pack portion by an adhesive bond between the frame and the back side of the pack portion;

the adhesive bond between the frame and the back side of the pack portion comprising a thermo-activated glue or glue-containing compound;

the anchoring part of the upper end of the shoulder strap being directly or indirectly adhesively bonded to the back side of the pack portion by an adhesive bond between the anchoring part of the upper end of the shoulder strap and the respective attachment portion of the back side of the pack portion;

the adhesive bond between the anchoring part of the upper end of the shoulder strap and the respective attachment portion of the back side of the pack portion comprising a thermo-activated glue or glue-containing compound;

the anchoring part of the upper end of the shoulder strap and the adhesive bond between the frame and the back side of the pack portion being positioned an equal distance from a reference point on the pack portion.

30. A backpack according to claim 29, further comprising:

a hip-belt connected to the pack portion via a pivot connection mechanism.

31. A backpack according to claim 30, wherein:

the pivot connection mechanism comprises at least one pivot part affixed to the back side of the pack portion by adhesive bonding.

32. A backpack according to claim 31, wherein:

the pivot part which is affixed to the back side of the pack comprises a base part with a peripheral outer flexible flange.

33. A backpack according to claim 32, wherein:

the flexible flange is integral with the base part of the pivot part.

34. A backpack according to claim 29, wherein:

the at least one shoulder strap of the carrying system comprises a pair of shoulder straps, each said shoulder strap being connected by an upper end and a lower end, respectively, to upper and lower shoulder strap attachment portions of the back side of the pack portion;

the carrying system further comprises a hip belt, the hip-belt being connected to at least one hip-belt attachment portion of the back side of the pack portion; and the frame extends along a region of the back side of the pack portion including at least the upper shoulder straps attachment portions and the hip-belt attachment portion of the back side of the pack portion.

35. A backpack according to claim 34, wherein:

the hip-belt is connected to the pack portion by an adhesive bond between the hip-belt and the pack portion.

36. A backpack according to claim 34, wherein:

the frame is substantially uniformly adhered along a substantial part of a surface in contact with the back side of the pack portion.

37. A backpack according to claim 29, wherein:

the thermo-activated glue or glue-containing compound between the frame and the back side of the pack portion is a thermo-activated adhesive film.

38. A backpack according to claim 37, wherein:

the frame is adhered to the back side of the pack portion via a gluing compound comprising at least one interfacial layer between two adhesive films.

39. A backpack according to claim 29, wherein:

the rigid or semi-rigid sheet of the frame is subdivided in at least two sheet frame elements each adhered to the back side of the pack portion.

40. A backpack according to claim 39, wherein:

the sheet elements are connected one to another by a rigid structure.

41. A backpack according to claim 29, wherein:

the pack portion is made of flexible waterproof material.

42. A backpack according to claim 41, wherein:

the flexible waterproof material of the pack portion comprises a plurality of panels joined together along junction lines protected for resistance to ingression of water.

43. A backpack according to claim 29, wherein:

the frame is adhesively bonded to an inner surface of the back side of the pack portion.

44. A backpack according to claim 29, wherein:

the adhesive bond bonds the frame to an outer surface of the back side of the pack portion so that the carrying system is indirectly connected to the pack portion via the frame.

45. A backpack according to claim 29, wherein:

the rigid or semi-rigid sheet of the frame is unitary.

46. A backpack according to claim 29, wherein:

the rigid or semi-rigid sheet of the frame includes a sheet of plastic material.

47. A backpack according to claim 29, wherein:

rigid or semi-rigid sheet comprises a plastic material adhesively bonded to a sheet of elastically compressible foam.

48. A backpack according to claim 29, wherein:

the sheet frame is reinforced by at least one rigid rod.

49. A backpack according to claim 29, wherein:

the pack portion is made of flexible waterproof material having an outer polyurethane coating having a peeling resistance of at least 10 pounds per inch according to Federal Test Method Standard 191A/5970.

50. A backpack according to claim 29, wherein:

separation of the frame and the back side of the pack portion requires undoing the adhesive bond between the frame and the back side of the pack portion.

51. A backpack according to claim 29, wherein:

at least at the shoulder strap attachment portion of the back side of the pack portion, the rigid or semi-rigid sheet of the frame is substantially flat; and a continuous and integral contact, with no void, exists between the adhesive bond of the frame and the adhesive bond of the shoulder strap attachment portion of the back side of the pack portion.

52. A backpack according to claim 29, wherein:

the frame has an outer surface area that is less than an outer surface area of the back side of the pack portion of the backpack.

53. A backpack according to claim 29, wherein:

the flexible material of the pack portion is a fabric.

54. A backpack according to claim 29, wherein:

the carrying system further comprises at least one load stabilizing strap having a lower end attached to the shoulder strap and an upper end attached to a stabilizing strap attachment portion of the back side of the pack portion;

the frame has an upper end terminating above the stabilizing strap attachment portion of the back side of the pack portion.

55. A method of manufacturing a backpack according to claim 29, said method comprising:

applying an adhesive bond between the sheet frame and the back side of the pack portion of the backpack by heating a thermo-activated glue or glue-containing compound situated between the sheet frame and the back side of the pack portion of the backpack; and applying an adhesive bond between the anchoring part of the upper end of the shoulder strap and the attachment portion of the back side of the pack portion of the backpack by heating a thermo-activated glue or glue-containing compound situated between the anchoring part of the upper end of the shoulder strap and the attachment portion of the back side of the pack portion of the backpack.

* * * * *